US007284333B2

(12) United States Patent
Lawler

(10) Patent No.: US 7,284,333 B2
(45) Date of Patent: Oct. 23, 2007

(54) CHAINSAW KICKBACK PROTECTION DEVICE

(76) Inventor: Julie Lawler, 1460 Circulo Sombrero, Rio Rico, AZ (US) 85648

( * ) Notice: Subject to any disclaimer, the term of this patent is extended or adjusted under 35 U.S.C. 154(b) by 0 days.

(21) Appl. No.: 11/417,818

(22) Filed: May 4, 2006

(65) Prior Publication Data

US 2006/0248734 A1 Nov. 9, 2006

Related U.S. Application Data

(60) Provisional application No. 60/678,739, filed on May 6, 2005.

(51) Int. Cl.
*B26B 17/02* (2006.01)

(52) U.S. Cl. ..... 30/382; 30/371

(58) Field of Classification Search ..... 30/370, 30/371, 381, 382, 383, 286
See application file for complete search history.

(56) References Cited

U.S. PATENT DOCUMENTS 3,059,673 A * 10/1962 Woleslagle ..... 30/161
3,182,695 A * 5/1965 Rigoni ..... 30/382
3,384,136 A * 5/1968 McDonagh et al. ..... 30/382
3,808,684 A * 5/1974 Ludwig ..... 30/382
4,193,193 A * 3/1980 Holzworth ..... 30/382
4,257,162 A * 3/1981 Pardon ..... 30/161
4,447,953 A * 5/1984 Lombardino et al. ..... 30/382
4,841,641 A * 6/1989 Laidlaw ..... 30/382
4,991,297 A * 2/1991 Cain ..... 30/382

* cited by examiner

*Primary Examiner*—Hwei-Siu C. Payer
(74) *Attorney, Agent, or Firm*—Raymond M. Galasso; David O. Simmons; Galasso & Associates, LP

(57) ABSTRACT

A chainsaw kickback protection device includes a chain guard and a mounting bracket assembly. The chain guard includes an elongated guard body and a chain-engaging member. The elongated guard body has a channel extending along at least a portion of its length. The chain-engaging member is disposed within the channel extending at least partially along a length of the channel. The mounting bracket assembly includes a mounting bracket and a connection structure. The connection structure is resiliently and pivotably connected between the mounting bracket and the elongated guard body. The connection structure biases the elongated guard body to a non-displaced orientation with respect to the mounting bracket. The connection structure enables the entire elongated guard body to move from the non-displaced orientation to a displaced orientation with respect to the mounting bracket.

19 Claims, 2 Drawing Sheets

FIG. 3
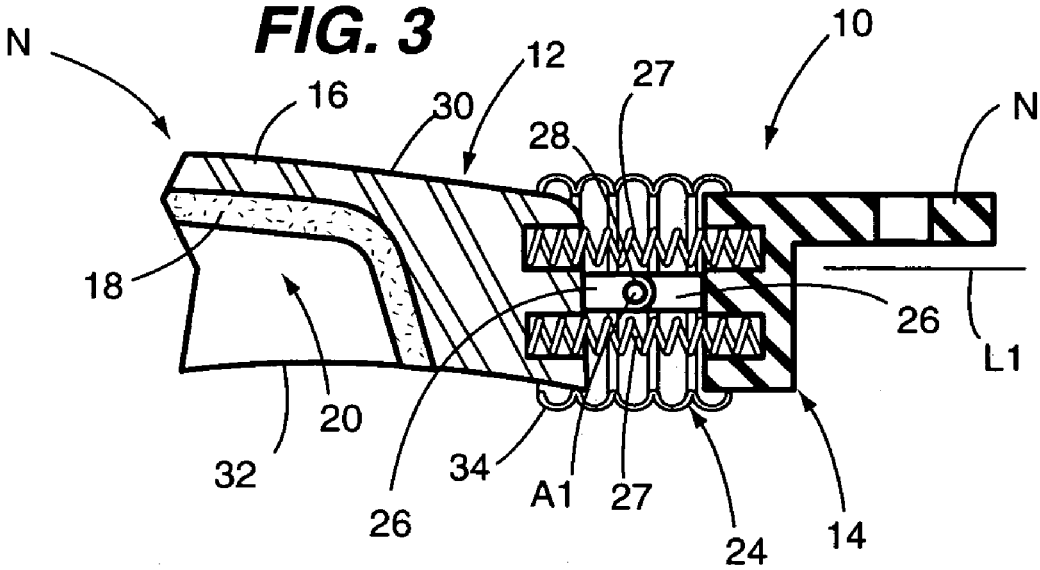
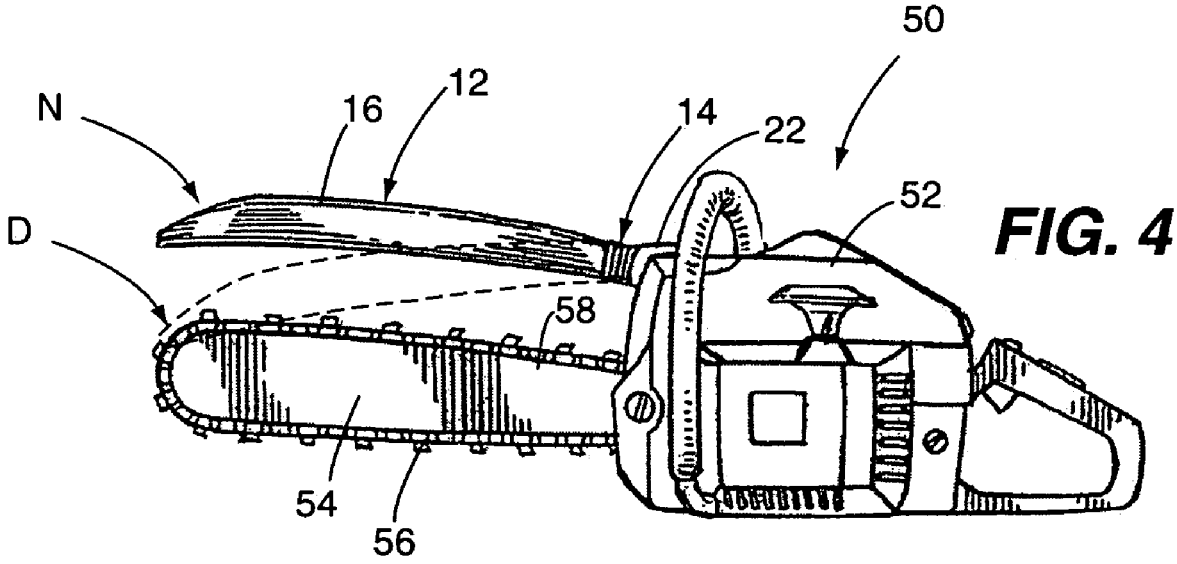
FIG. 4

CHAINSAW KICKBACK PROTECTION DEVICE

CROSS REFERENCE TO RELATED APPLICATIONS

This patent application claims priority to co-pending U.S. Provisional Patent Application having Ser. No. 60/678,739 filed May, 6, 2005 entitled "chainsaw kickback protector", having a common applicant herewith and being incorporated herein in its entirety by reference.

FIELD OF THE DISCLOSURE

The disclosures made herein relate generally to chainsaw accessory items and, more particularly, to chainsaw kickback protection devices.

BACKGROUND

The use of hand-held chainsaws has become quite prevalent. They are used as tools of the trade by professionals such as, for example, loggers, tree trimmers and the like. Homeowners also use chainsaws for both routine and major yard projects. The use of a chainsaw brings with it the potential for severe injury. One of the main causes of injury is so-called chainsaw "kickback", which is characterized as a saw portion of the chainsaw being thrown in upward and backward toward the operator. One examples of a situation that cause chainsaw kickback is a chain of the chainsaw striking a knot in wood being cut. Another example is an upper run of the chain (i.e., the chain above a chain bar of the chainsaw) engaging a branch or log while a lower run of the chain is cutting a piece of wood. Regardless of the specific situation that causes kickback, the chainsaw kicksback and, if the operator is unprepared, the momentum may carry the chain saw back far enough, allowing the upper run of the chain to strike the operator in the chest or head thereby causing severe injury.

To overcome this problem, various chain saw guards have been proposed to minimize this problem. While satisfactory, perhaps, these conventional chainsaw guards generally have been found to have certain drawbacks. For example, some are rather complicated in construction and cumbersome to use. Others do not allow for ready attachment to a variety of different types of chain saws, nor afford easy assembly and disassembly. Still others do not allow for ready viewing of the chain, while at the same time affording protection to the operator from flying debris and the possibility of kickback. Still others do not at least partially conceal the saw chain during kickback.

Therefore, it is an object of the present invention to provide a chain saw guard that overcomes drawbacks associated with conventional chainsaw guards in a useful, advantageous and novel manner.

SUMMARY OF THE DISCLOSURE

In one embodiment of the present invention, a chainsaw kickback protection device includes an elongated chain guard and a mounting bracket assembly. The elongated chain guard has a chain-receiving channel extending at least partially along a length thereof. The mounting bracket assembly includes a mounting bracket and a connection structure. The connection structure is connected between the mounting bracket and the elongated chain guard. The connection structure biases the elongated chain guard to a non-displaced orientation with respect to the mounting bracket. The connection structure enables the entire elongated chain guard to move from the non-displaced orientation to a displaced orientation with respect to the mounting bracket.

In another embodiment of the present invention, a chainsaw kickback protection device includes a chain guard and a mounting bracket assembly. The chain guard includes an elongated guard body and a chain-engaging member. The elongated guard body has a channel extending along at least a portion of its length. The chain-engaging member is disposed within the channel and extends at least partially along a length of the channel. The mounting bracket assembly includes a mounting bracket and a connection structure. The connection structure is resiliently and pivotably connected between the mounting bracket and the elongated guard body. The connection structure biases the elongated guard body to a non-displaced orientation with respect to the mounting bracket. The connection structure enables the entire elongated guard body to move from the non-displaced orientation to a displaced orientation with respect to the mounting bracket.

In another embodiment of the present invention, a chainsaw includes an engine block assembly, a chain bar attached to and extending from the engine block assembly and a chainsaw kickback protection device attached to the engine block assembly and extending directly over a top portion of the chain bar. The chainsaw kickback protection device includes a chain guard, a mounting bracket and a connection structure. The connection structure is connected between the mounting bracket and the chain guard. The mounting bracket is fixedly attached to the engine block assembly. The chain guard has an elongated chain-receiving channel extending at least partially along a length of the chain guard. The connection structure is connected between the mounting bracket and the chain guard. The connection structure biases the chain guard to a non-displaced orientation with respect to the mounting bracket. The connection structure enables the entire chain guard to move from the non-displaced orientation to a displaced orientation with respect to the mounting bracket.

Turning now to specific aspects of the present invention, in at least one embodiment, the connection structure limits movement of the elongated chain guard to pivoting about a single pivot axis.

In at least one embodiment of the present invention, the single pivot axis extends substantially at a right angle to a longitudinal centerline of the elongated chain guard and substantially transverse to the chain-receiving channel.

In at least one embodiment of the present invention, the elongated chain guard has an open bottom face and a closed top face opposite the open bottom face, and the connection structure limits movement of the elongated chain guard to pivoting in an up direction and a down direction with respect to the open bottom face and the closed top face.

In at least one embodiment of the present invention, the elongated chain guard includes an elongated guard body and a chain-engaging member, the chain-receiving channel is within the elongated guard body, and the chain-engaging member is disposed within the channel extending at least partially along a length of the chain-receiving channel.

In at least one embodiment of the present invention, the elongated guard body is made of a polymeric material having a first flexural strength and a first durometer, the chain-engaging member is made of a polymeric material having a second flexural strength and a second durometer, and the first flexural strength and the first durometer are greater than the second flexural strength and the second durometer, respectively.

These and other objects, embodiments, advantages and/or distinctions of the present invention will become readily apparent upon further review of the following specification, associated drawings and appended claims.

BRIEF DESCRIPTION OF THE DRAWINGS

FIG. 3 is a cross-sectional view taken along the line 3-3 in FIG. 1.

FIG. 4 shows the chainsaw kickback protection device in combination with a conventional chainsaw.

DETAILED DESCRIPTION OF THE DRAWING FIGURES

Figure 1:
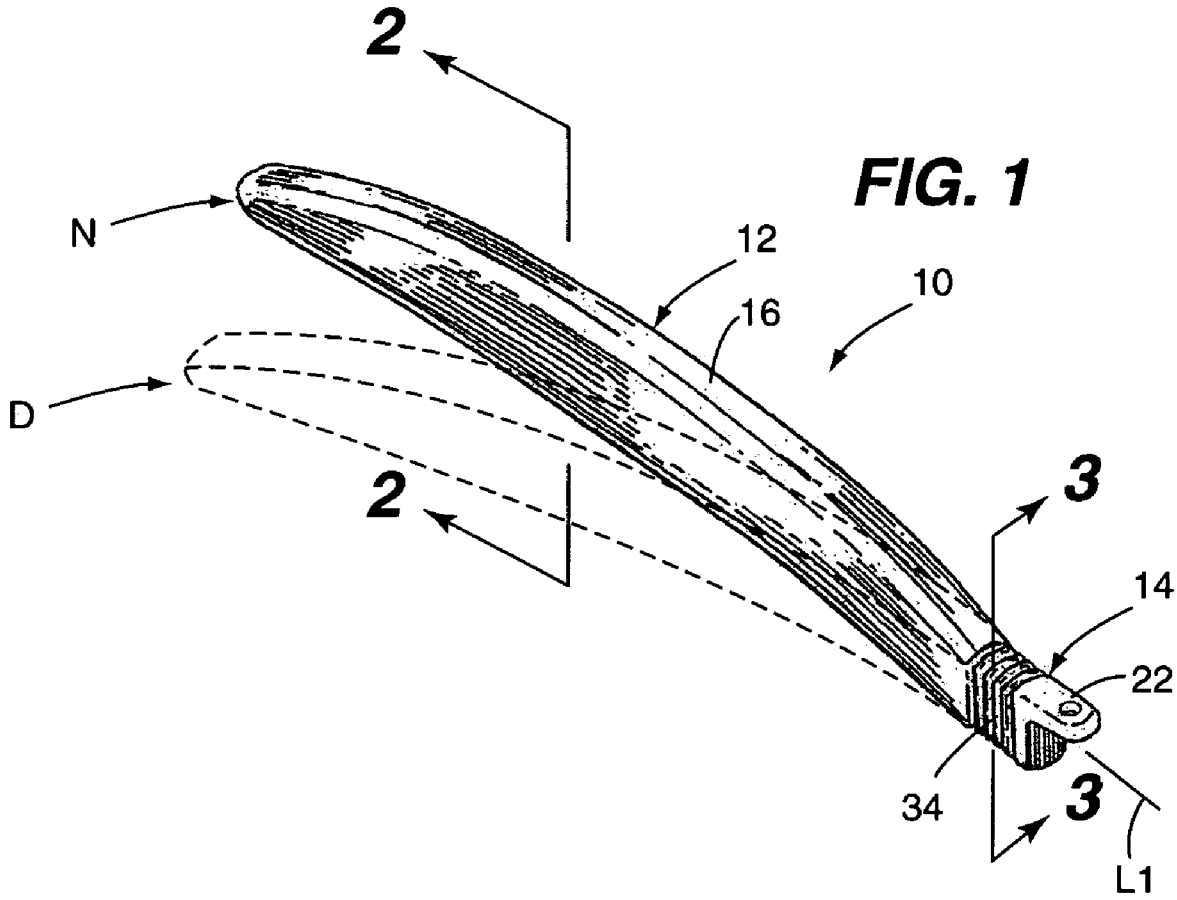
FIG. 1 is a perspective view showing a chainsaw kickback protection device in accordance with the present invention.
Figure 2:
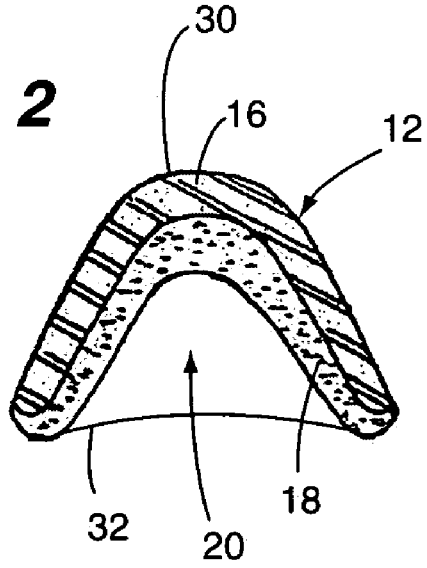
FIG. 2 is a cross-sectional view taken along the line 2-2 in FIG. 1.

FIGS. 1-4 show various aspects of a chainsaw kickback protection device in accordance with the present invention. The chainsaw kickback protection device shown in FIGS. 1-4 is referred to herein as the chainsaw kickback protection device 10. The chainsaw kickback protection device 10 overcomes drawbacks associated with conventional chainsaw guards and provides for kickback protection functionality in a useful, advantageous and novel manner.

The chainsaw kickback protection device 10 includes a chain guard 12 and a mounting bracket assembly 14. The chain guard 12 includes an elongated guard body 16 and a chain-engaging member 18. The elongated guard body 16 has a channel 20 (FIGS. 2 and 3) extending along at least a portion of its length. The chain-engaging member 18 is disposed within the channel 20 and is engaged with an entire portion of a surface of the elongated guard body 16 that defines the channel 20. It is disclosed herein that, optionally, the chain-engaging member 18 may be engaged with less than the entire portion of the surface of the elongated guard body 16 that defines the channel 20. Furthermore, it is disclosed herein that the chain-engaging member 18 may be omitted or may be removably attached to allow for its replacement.

As shown, the elongated guard body 16 has a v-shaped cross-sectional profile in the region that defines the channel 20. Optionally, however, the elongated guard body 16 may have a different cross-sectional profile in the region that defines the channel 20 (e.g., u-shaped). The present invention is not limited to the elongated guard body 16 having a particular cross-sectional shape in the region that defines the channel 20.

The mounting bracket assembly 14 includes a mounting bracket 22 and a connection structure 24. The mounting bracket may be configured in a universal manner for being attached to almost any brand/model of chainsaw or may be configured for attachment to a particular brand/model of chainsaw. The connection structure 24 is resiliently and pivotably connected between the mounting bracket 22 and the elongated guard body 16. In a specific embodiment as depicted in FIG. 3, the connection structure 24 includes spaced apart hinges 26 (only one shown in the cross sectional view) and spaced apart springs 27. The spaced apart hinges 26 are in a side-by side orientation connected between the mounting bracket 22 and the elongated guard body 16. The spaced apart springs 27 are in an over-under orientation engaged between the mounting bracket 22 and the elongated guard body 16 (i.e., constrained within respective pockets of the mounting bracket 22 and the elongated guard body 16). A pivot axis A1 extends through pivot pins 28 of each one of the hinges 26. The pivot axis A1 extends substantially at a right angle to a longitudinal centerline L1 of the elongated chain guard 16 and substantially transverse a plane that effectively bisects the channel 20. In this manner, the connection structure limits movement of the elongated chain guard to pivoting about a single pivot axis (i.e., pivot axis A1).

The spaced apart springs 27 bias the elongated guard body 16 to a non-displaced orientation N with respect to the mounting bracket 22 and enables the entire elongated guard body 16 to move from the non-displaced orientation N to a displaced orientation D with respect to the mounting bracket 22. The connection structure 24 further includes a resilient dust boot 34 that covers and protects the spaced apart hinges 26 and the spaced apart springs 27 from contaminants and damage.

It is disclosed herein that the present invention is not limited to a particular configuration of connection structure. Thus, a connection structure in accordance with the present invention may utilize various types and combinations of elements for enabling directionally constrained displacement. For example, in a broad interpretation, the elongated chain guard 16 has an open bottom face 32 and a closed top face 30 opposite the open bottom face 32. The connection structure 24 limits movement of the elongated chain guard to pivoting in an up direction and a down direction with respect to the open bottom face 32 and the closed top face 30.

In one embodiment, the elongated guard body is preferably made of a first polymeric material having a first flexural strength and a first durometer and the chain-engaging member is preferably made of a second polymeric material having a second flexural strength and a second durometer. Furthermore, the first flexural strength and the first durometer are preferably greater than the second flexural strength and the second durometer, respectively. Polymeric materials such as nylon and polypropylene are examples of the first polymeric material and polymeric materials such as thermoplastic elastomers and high-density foams are examples of the second polymeric material.

Referring now to FIG. 4, the chainsaw kickback protection device 10 is shown in combination with a chainsaw 50. The chainsaw 50 includes an engine block assembly 52 and a chain bar 54. The chain bar 54 is attached to and extends from the engine block assembly 52. A sawing chain 56 is rotatably engaged with chain bar 54. As is consistent with operation of a chainsaw, a drive portion of an engine such as a clutch arrangement (not shown) causes the chain to rotate, thereby facilitating cutting action.

The chainsaw kickback protection device 10 is attached to the engine block assembly 52 via the mounting bracket 22. The chainsaw kickback protection device 10 extends directly over a top portion 58 of the chain bar 54. Furthermore, the chainsaw kickback protection device 10 preferably, but not necessarily, extends along an entire length of the chain bar 54.

In operation, the chainsaw 50 may exhibit kickback, which is a condition where the saw portion (i.e., chain bar 54 and saw chain 56) is thrown upward and backward toward the operator. During such kickback, the chainsaw kickback protection device 10 is configured for enabling the elongated guard body 16 to move from the non-displaced orientation N to the displaced orientation D such that the saw portion is partially concealed by the channel 20 (i.e., the chain-receiving channel) to limit the potential for a body of a person to come into contact with the saw chain 56. Additionally, the chainsaw kickback protection device 10 may be configured such that the elongated guard body 16 moves sufficiently to allow the chain-engaging member 18 to engage the saw chain 56 thereby causing the saw chain 56 to decelerate and, thus, limit potential injury to the operator.

In one embodiment, to enable movement of the elongated guard body 16, the connection structure 14 is configured for enabling the elongated guard body 16 to move from the non-displaced orientation N toward the displaced orientation D when a suitable force is physically applied thereto. For example, when the kickback causes the elongated guard body 16 to hit the body of the operator with sufficient force, the elongated guard body 16 moves from the non-displaced orientation N toward the displaced orientation D. When the elongated guard body 16 hits the body of the operator with sufficient force, the elongated guard body 16 is displaced far enough toward the displaced orientation D so as to cause the chain-engaging member 18 to engage the saw chain 56.

In another embodiment, to enable movement of the elongated guard body 16, the connection structure 14 is configured for enabling the elongated guard body 16 to move from the non-displaced orientation N toward the displaced orientation D when a suitable inertial force is generated by motion of the chainsaw 50 caused the kickback. Accordingly, the actual degree of displacement from the non-displaced orientation to the displaced orientation D is proportional to the magnitude of the kickback action. With a sufficiently large kickback action, the inertial force causes the elongated guard body 16 to displace far enough toward the displaced orientation D so as to cause the chain-engaging member 18 to engage the saw chain 56.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A chainsaw kickback protection device, comprising:

an elongated chain guard having a chain-receiving channel extending at least partially along a length thereof; and a mounting bracket assembly including a mounting bracket and a connection structure, wherein the connection structure comprises:

spaced apart springs in an over-under orientation;

spaced apart hinges in side-by-side orientation each spaced apart hinge comprising a pivot pin; and a dust boot to cover and protect the spaced apart hinges and the spaced apart springs;

wherein the connection structure is connected between the mounting bracket and the elongated chain guard, wherein the connection structure biases the elongated chain guard to a non-displaced orientation with respect to the mounting bracket and wherein the connection structure enables the entire elongated chain guard to move from the non-displaced orientation to a displaced orientation with respect to the mounting bracket.

2. The chainsaw kickback protection device of claim 1 wherein the connection structure limits movement of the elongated chain guard to pivoting about a single pivot axis.

3. The chainsaw kickback protection device of claim 2 wherein the single pivot axis extends substantially at a right angle to a longitudinal centerline of the elongated chain guard and substantially transverse to the chain-receiving channel.

4. The chainsaw kickback protection device of claim 1 wherein:

the elongated chain guard has an open bottom face and a closed top face opposite the open bottom face; and the connection structure limits movement of the elongated chain guard to pivoting in an up direction and a down direction with respect to the open bottom face and the closed top face.

5. The chainsaw kickback protection device of claim 1 wherein:

the elongated chain guard includes an elongated guard body and a chain-engaging member;

the chain-receiving channel is within the elongated guard body; and the chain-engaging member is disposed within the channel extending at least partially along a length of the chain-receiving channel.

6. The chainsaw kickback protection device of claim 5 wherein:

the elongated guard body is made of a polymeric material having a first flexural strength.

7. The chainsaw kickback protection device of claim 6 wherein:

the elongated guard body has an open bottom face and a closed top face opposite the open bottom face; and the connection structure limits movement of the elongated guard body to pivoting in an up direction and a down direction with respect to the open bottom face and the closed top face.

8. A chainsaw kickback protection device, comprising:

a chain guard including an elongated guard body and a chain-engaging member, wherein the elongated guard body has a channel extending along at least a portion of its length and wherein the chain-engaging member is disposed within the channel extending at least partially along a length of the channel; and a mounting bracket assembly including a mounting bracket and a connection structure, wherein the connection structure comprises:

spaced apart springs in an over-under orientation;

spaced apart hinges in side-by-side orientation each spaced apart hinge comprising a pivot pin; and a dust boot to cover and protect the spaced apart hinges and the spaced apart springs;

wherein the connection structure is resiliently and pivotably connected between the mounting bracket and the elongated guard body, wherein the connection structure biases the elongated guard body to a non-displaced orientation with respect to the mounting bracket and wherein the connection structure enables the entire elongated guard body to move from the non-displaced orientation to a displaced orientation with respect to the mounting bracket.

9. The chainsaw kickback protection device of claim 8 wherein the connection structure limits movement of the chain guard to pivoting about a single pivot axis.

10. The chainsaw kickback protection device of claim 9 wherein the single pivot axis extends substantially at a right angle to a longitudinal centerline of the chain guard and substantially transverse to the channel.

11. The chainsaw kickback protection device of claim 8 wherein:

the chain guard has an open bottom face and a closed top face opposite the open bottom face; and the connection structure limits movement of the chain guard to pivoting in an up direction and a down direction with respect to the open bottom face and the closed top face.

12. The chainsaw kickback protection device of claim 8 wherein:

the elongated guard body is made of a polymeric material having a first flexural strength;

the chain-engaging member is made of a polymeric material having a second flexural strength.

13. The chainsaw kickback protection device of claim 12 wherein:

the elongated guard body has an open bottom face and a closed top face opposite the open bottom face; and the connection structure limits movement of the elongated guard body to pivoting in an up direction and a down direction with respect to the open bottom face and the closed top face.

14. A chainsaw, comprising:

an engine block assembly;

a chain bar attached to and extending from the engine block assembly; and a chainsaw kickback protection device attached to the engine block assembly and extending directly over a top portion of the chain bar, wherein the chainsaw kickback protection device includes a chain guard, a mounting bracket and a connection structure having spaced apart springs in an over-under orientation and spaced apart hinges in side-by-side orientation each spaced apart hinge comprising a pivot pin; and a dust boot to cover and protect the spaced apart hinges and the spaced apart springs; wherein the connection structure is connected between the mounting bracket and the chain guard, wherein the mounting bracket is fixedly attached to the engine block assembly, wherein the chain guard has an elongated chain-receiving channel extending at least partially along a length of the chain guard, wherein the connection structure biases the chain guard to a non-displaced orientation with respect to the mounting bracket and wherein the connection structure enables the entire chain guard to move from the non-displaced orientation to a displaced orientation with respect to the mounting bracket.

15. The chainsaw of claim 14 wherein:

the connection structure limits movement of the chain guard to pivoting about a single pivot axis; and the single pivot axis extends substantially at a right angle to a longitudinal centerline of the chain guard and substantially transverse to the chain-receiving channel.

16. The chainsaw of claim 14 wherein:

the chain guard has an open bottom face and a closed top face opposite the open bottom face; and the connection structure limits movement of the chain guard to pivoting in an up direction and a down direction with respect to the open bottom face and the closed top face.

17. The chainsaw of claim 14 wherein:

the chain guard includes an elongated guard body and a chain-engaging member;

the chain-receiving channel is within the elongated guard body; and the chain-engaging member is disposed within the channel extending at least partially along a length of the chain-receiving channel.

18. The chainsaw of claim 17 wherein:

the elongated guard body is made of a polymeric material having a first flexural strength and;

the chain-engaging member is made of a polymeric material having a second flexural strength.

19. The chainsaw of claim 18 wherein:

the elongated guard body has an open bottom face and a closed top face opposite the open bottom face; and the connection structure limits movement of the elongated guard body to pivoting in an up direction and a down direction with respect to the open bottom face and the closed top face.

* * * * *